US006722351B2

(12) United States Patent
Vamvakitis et al.

(10) Patent No.: US 6,722,351 B2
(45) Date of Patent: Apr. 20, 2004

(54) EGR VALVE APPARATUS

(75) Inventors: Dimitri L. Vamvakitis, Pontiac, MI (US); Richard J. Vaughan, Ormond Beach, FL (US); Jerry Holden, Smithville, TN (US)

(73) Assignee: Cooper Technology Services, LLC, Findlay, OH (US)

( * ) Notice: Subject to any disclaimer, the term of this patent is extended or adjusted under 35 U.S.C. 154(b) by 0 days.

(21) Appl. No.: 10/286,158

(22) Filed: Oct. 30, 2002

(65) Prior Publication Data

US 2003/0075159 A1 Apr. 24, 2003

Related U.S. Application Data

(63) Continuation-in-part of application No. PCT/US01/14200, filed on May 3, 2001.

(60) Provisional application No. 60/201,391, filed on May 3, 2000, provisional application No. 60/234,432, filed on Sep. 21, 2000, and provisional application No. 60/235,828, filed on Sep. 27, 2000.

(51) Int. Cl.[7] ..... F02M 25/07

(52) U.S. Cl. ..... 123/568.2; 123/568.21; 123/568.23; 123/568.18

(58) Field of Search ..... 123/568.11, 568.12, 123/568.13, 568.18, 568.2, 568.21, 568.23, 568.24, 90.22, 90.23; 60/605.2

(56) References Cited

U.S. PATENT DOCUMENTS

| | | | | |
|---|---|---|---|---|
| 4,064,851 A | | 12/1977 | Wessel | |
| 4,313,415 A | | 2/1982 | Shinzawa | |
| 4,690,119 A | | 9/1987 | Makino et al. | |
| 5,375,568 A | * | 12/1994 | Manolis et al. | 123/90.22 |
| 5,503,131 A | | 4/1996 | Ohuchi | |
| 5,606,957 A | | 3/1997 | Feucht | |
| 5,921,209 A | * | 7/1999 | Regueiro | 123/90.22 |
| 5,974,802 A | | 11/1999 | Blake | |
| 5,988,128 A | * | 11/1999 | Moriya et al. | 123/90.18 |
| 6,006,732 A | | 12/1999 | Oleksiewicz | |
| 6,014,960 A | | 1/2000 | Olelksiewicz | |
| 6,039,034 A | | 3/2000 | Field et al. | |
| 6,116,223 A | * | 9/2000 | Feucht | 123/568.2 |
| 6,279,552 B1 | * | 8/2001 | Okada et al. | 123/568.2 |
| 6,293,266 B1 | * | 9/2001 | Oetting | 123/568.2 |
| 6,571,782 B2 | * | 6/2003 | Brosseau et al. | 123/568.18 |

* cited by examiner

*Primary Examiner*—Willis R. Wolfe
(74) *Attorney, Agent, or Firm*—Carlson, Gaskey & Olds

(57) ABSTRACT

An EGR valve apparatus regulates the amount of exhaust gas recirculated in an EGR system. The EGR valves are opened or closed by a rotatable shaft which is actuated by a motor. Alternatively, the valves can be balanced on the shaft, the valves moving in opposing direction during rotation. An inline poppet can be employed to overcome pressure in the system prior to movement of the valves. In another alternative embodiment, the motor rotates threaded shaft to move a pintle towards and away from an orifice.

31 Claims, 6 Drawing Sheets

EGR VALVE APPARATUS

This application is a continuation in part of PCT Application NO. PCT/US01/14200 filed on May 3, 2001, which claims priority to also provisional patent application Nos. 60/201,391 filed on May 3, 2000; 60/234,432 filed on Sep. 21, 2000 and 60/235,828 filed on Sep. 27, 2000. The PCT Application was published under PCT Article 21(2) in English.

BACKGROUND OF THE INVENTION

The present invention relates generally to an exhaust gas recirculation (EGR) system for regulating the flow of an exhaust gas.

EGR systems are increasingly being utilized to improve the efficiency of engines and reduce the harmful effects of the exhaust gas on the environment. As an engine burns fuel, it produces an exhaust gas which contains unburned fuel and other impurities. In an EGR system, the exhaust gas is redirected through the engine to burn any unburned fuel remaining in the exhaust gas. Reburning the exhaust gas before it is released reduces the harmful effects of the exhaust gas on the atmosphere and enables the vehicle to meet government emission standards.

In order to recirculate the exhaust gas, EGR systems typically include a valve and a cooler. The valve regulates the amount of exhaust gas that is introduced back into the engine. The cooler cools the exhaust gas to a specified temperature which condenses the unburned fuel.

Prior EGR systems utilize a vacuum source with a diaphragm actuator to open and close the valve. The diaphragm actuator has a slow response time and is either open or closed with no intermediate valve position. One drawback to the prior art is that the slow response time of valves reduce the horsepower and efficiency of the engine, limiting the amount the EGR system may be used.

Hence, there is a need for an improved exhaust gas recirculation system for regulating the flow of an exhaust gas.

SUMMARY OF THE INVENTION

The present invention relates to an exhaust gas recirculation system for regulating the flow of an exhaust gas.

The exhaust gas recirculation system includes an EGR valve apparatus which regulates the amount of exhaust gas that is recirculated in the system. In one embodiment, a motor rotates a shaft which opens or closes a plurality of valves. The amount of exhaust gas flowing through the EGR valve apparatus is proportional to the amount the valves are opened or closed.

In a second embodiment, a force balanced rotary EGR valve assembly including balance seat valves is utilized. When more exhaust is to enter a chamber, the shaft is rotated, moving a downward balanced seat rotary EGR valve downwardly out of the chamber against the flow of exhaust and an upward balanced seat rotary EGR valve upwardly into the chamber with the flow of exhaust. Rotating the shaft in the opposite direction reverses the movement of the valves, allowing less exhaust gas to enter the chamber.

A third embodiment includes an inline poppet located on each valve which opens to allow gas to enter the chamber before the EGR valve is opened to overcome the pressure in the system. A cam translates the rotary motion of the motor shaft to the linear motion of a valve shaft to open the EGR valve.

Alternatively, the motor rotates the motor shaft to pivot a balance arm in a fourth embodiment. A first end of the arm moves upwardly to raise an EGR valve, and a second end of the arm moves downwardly to lower an EGR valve, allowing more exhaust gas to enter the chamber. Reverse rotation of the shaft reverses the movement of the valves, allowing less exhaust gas to enter the chamber.

In a fifth embodiment, an air venturi apparatus is employed. The motor rotates a shaft of a poppet, separating a pintle from an orifice. The degree of separation of the pintle from the orifice allows a proportional amount of a fresh air/exhaust gas mixture to return to the system.

Accordingly, the present invention provides an exhaust gas recirculation system for regulating the flow of an exhaust gas.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows:

FIG. 8 illustrates an interior cross-sectional view of an alternate fourth embodiment of the valve apparatus.

DETAILED DESCRIPTION OF THE PREFERRED EMBODIMENT

Figure 1:
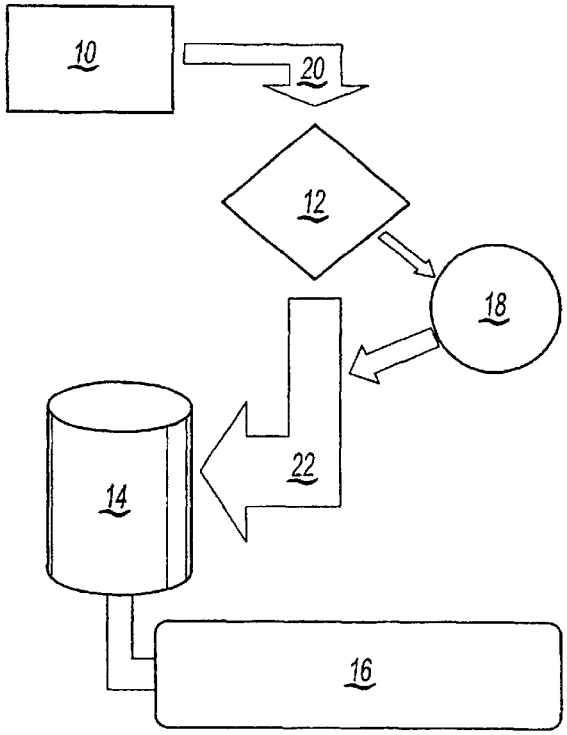
FIG. 1 illustrates a flow diagram for an exhaust recirculation system which regulates the flow of an exhaust gas.

The exhaust gas recirculation (EGR) system, illustrated in FIG. 1, comprises an engine control unit (ECU) 10 which transits a pulse width modulated (PWM) signal 20 to a printed circuit board (PCB) pilot circuit 12. A PWM signal 20 is not strong enough to operate a motor 14, the pilot circuit 12 is connected to a second current source 18, such as a battery, which increases the strength of the PWM signal 20. The pilot circuit 12 then transmits a second signal 22 to the motor 14, which actuates a valve apparatus 16 to control the flow of a fresh air/exhaust gas mixture back into the system. It is preferred that the motor 14 is an electric D/C motor 14, preferably a monophase electromagnetic actuator.

The ECU 10 is programmed to operate the EGR system at certain customer specified duty cycles. As a vehicle travels at a constant speed, the ECU 10 transmits a signal to operate the EGR system at full capacity. However, when the vehicle requires maximum horsepower, such as during acceleration, the ECU 10 transmits the PWM signal 20 to close the valves apparatus 16, to step exhaust gas recirculation. The ECU 10 is limited by being able to transmit a signal of no more than 1.3 amps.

Figure 2:
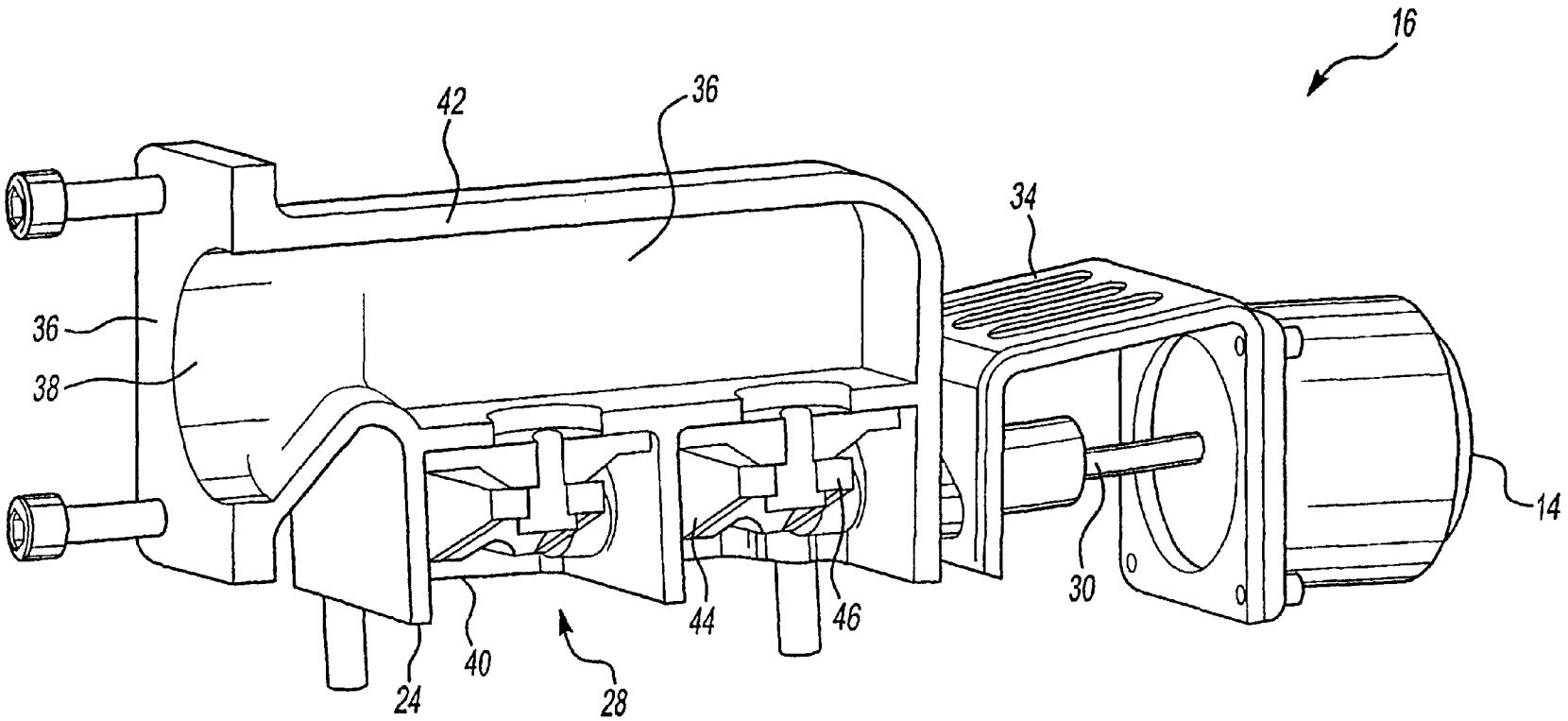
FIG. 2 is a perspective view of a first embodiment of the valve apparatus of the present invention.

FIG. 2 illustrates a first embodiment of the EGR valve apparatus 16 of the present invention. A non-contact sensor of the motor 14 receives a signal from the pilot circuit 12 and in response rotates a shaft 30 to proportionally open or close a plurality of valves 28. The motor 14 is attached to a housing 42 by a bracket 34, which provides support for the shaft 30 and withstands the torque produced as the shaft 30 rotates.

Each of the valves 28 includes an arm 44 connected to a disc 46 by a pin. As the shaft 30 rotates, the arm 44 pivots and the disc 46 moves, opening and closing the valves 28. In this embodiment, each of the valves 28 are substantially positioned on the same side of the shaft 30.

After the valves 28 have been opened, exhaust gas flows from the engine, which is fastened to the housing 42 at a first mounting face 24, through an exhaust gas inlet 40. The exhaust gas enters a chamber 36 and exits the valve assembly 16 through the outlet 38. The exhaust gas then flows into a cooler, which is fastened to the housing 42 at a second mounting face 26. While multiple valves are shown for increased exhaust gas flow, only one may be used if desired.

Figure 3:
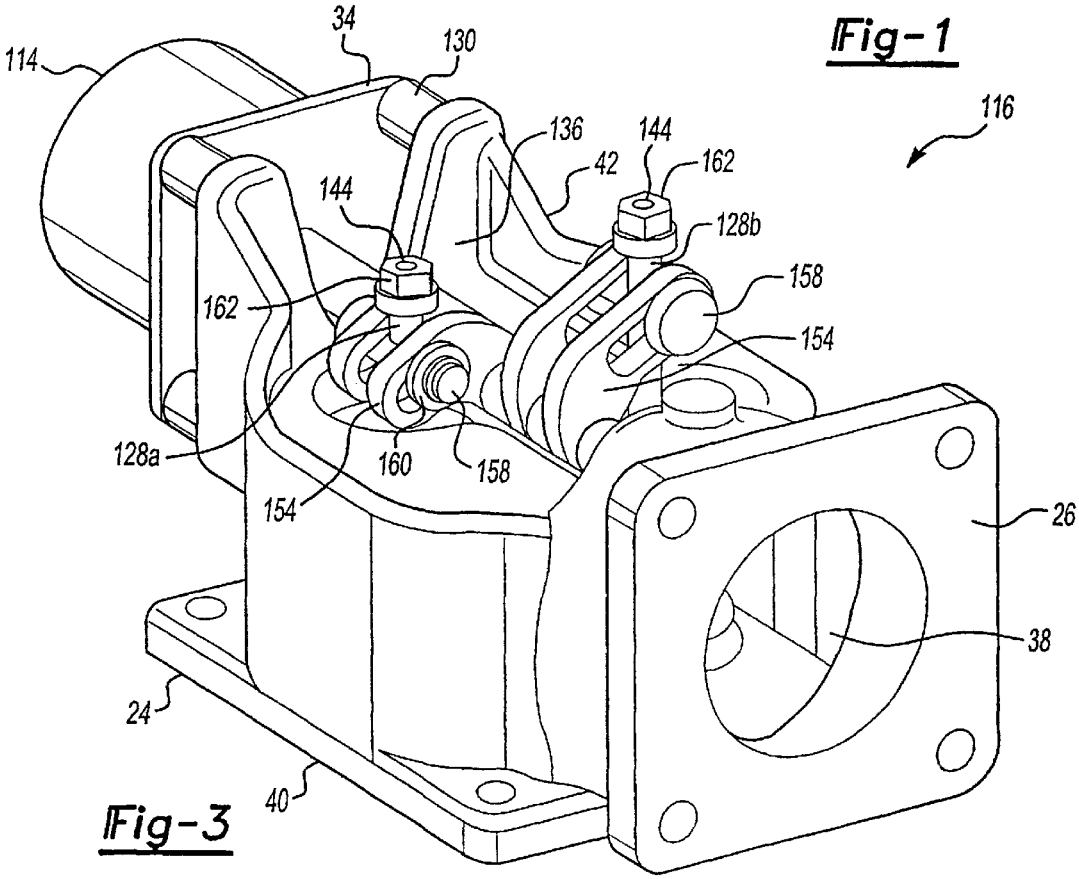
FIG. 3 illustrates a perspective view of a second embodiment of the valve apparatus employing a forced balanced seat EGR valve assembly.

In a second embodiment, as illustrated in FIG. 3, a valve assembly 116 including force balanced seat rotary EGR valves 128 is utilized. As the motor 114 operates, the shaft 130 rotates to proportionally raise and lower the rotary EGR valves 128 allowing exhaust to enter the chamber 136 from the engine. While a pair of force balanced rotary EGR valves 128 are illustrated, any number may be utilized. In this embodiment, the rotary EGR valves 128 are positioned on opposite sides of the shaft 130.

Figure 4:
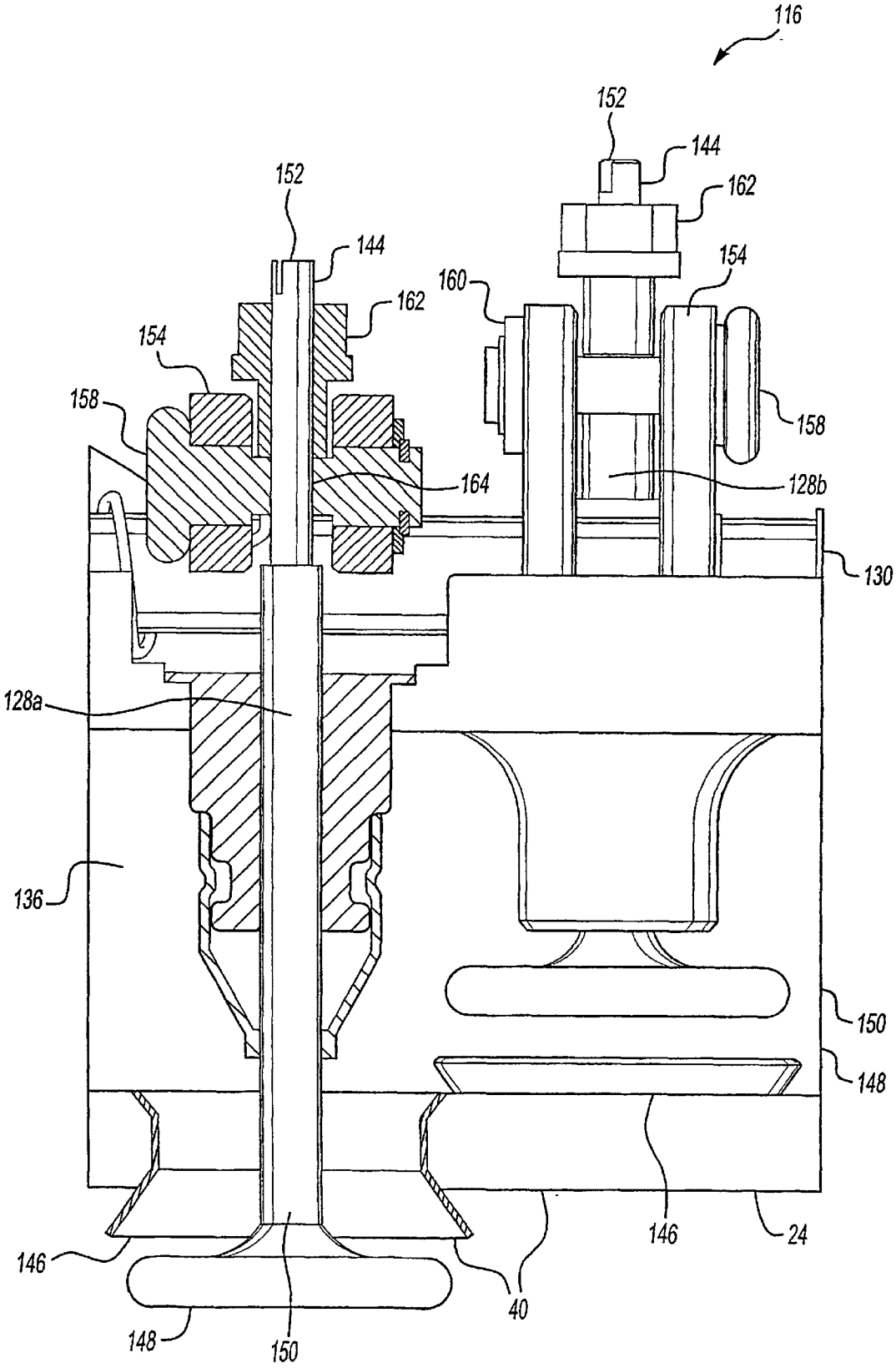
FIG. 4 illustrates a cross sectional side view of the valves of the force balanced rotary EGR valve assembly of the second embodiment.

As illustrated in FIG. 4, each rotary EGR valve 128 includes a pintle 148 attached to a bottom portion 150 of a valve shaft 144. When more exhaust is to enter the system, the shaft 130 is rotated so that the downward rotary EGR valve 128*a* moves downwardly out of the chamber 136 against the flow of exhaust, and the upward rotary EGR valve 128*b* moves upwardly into the chamber 136 with the flow of exhaust. The degree of rotation of the shaft 130 determines the amount the rotary EGR valves 128*a*, 128*b* are opened. It is preferred that the shaft 130 be rotated 20°, although other degrees of rotation are possible depending on system requirements. When less exhaust is to enter the system, the shaft 130 is rotated in the opposite direction, reversing the abovementioned movement of the valves 128*a*, 128*b*. When no exhaust is to enter the system, the pintles 148 of the rotary EGR valves 128 fit securely into an orifice 146 cut into the first mounting face 24 of the housing 42, preventing exhaust from being recirculated into the system.

As further illustrated in FIG. 4, an upper portion 152 of each valve shaft 144 is attached to a curved arm 154 secured to the motor shaft 130 by a pin 158, the valve shaft 144 being positioned within an orifice 164 in the pin 158. Wave washers 160 are utilized to reduce wear. A threaded nut 162 positioned on the upper portion 152 of the valve shaft 144 secures the assembly.

As the motor 114 rotates the shaft 130 according to the required input, the arms 154 pivot and transfer the rotational movement of the shaft 130 into the linear movement of the rotary EGR valves 128*a*, 128*b*. A spring can be employed on the motor shaft 130 proximate to the motor 114 to prevent vibrations and to act as a fail safe mechanism to close the valves 128*a*, 128*b* if the motor 114 loses power.

Figure 5:
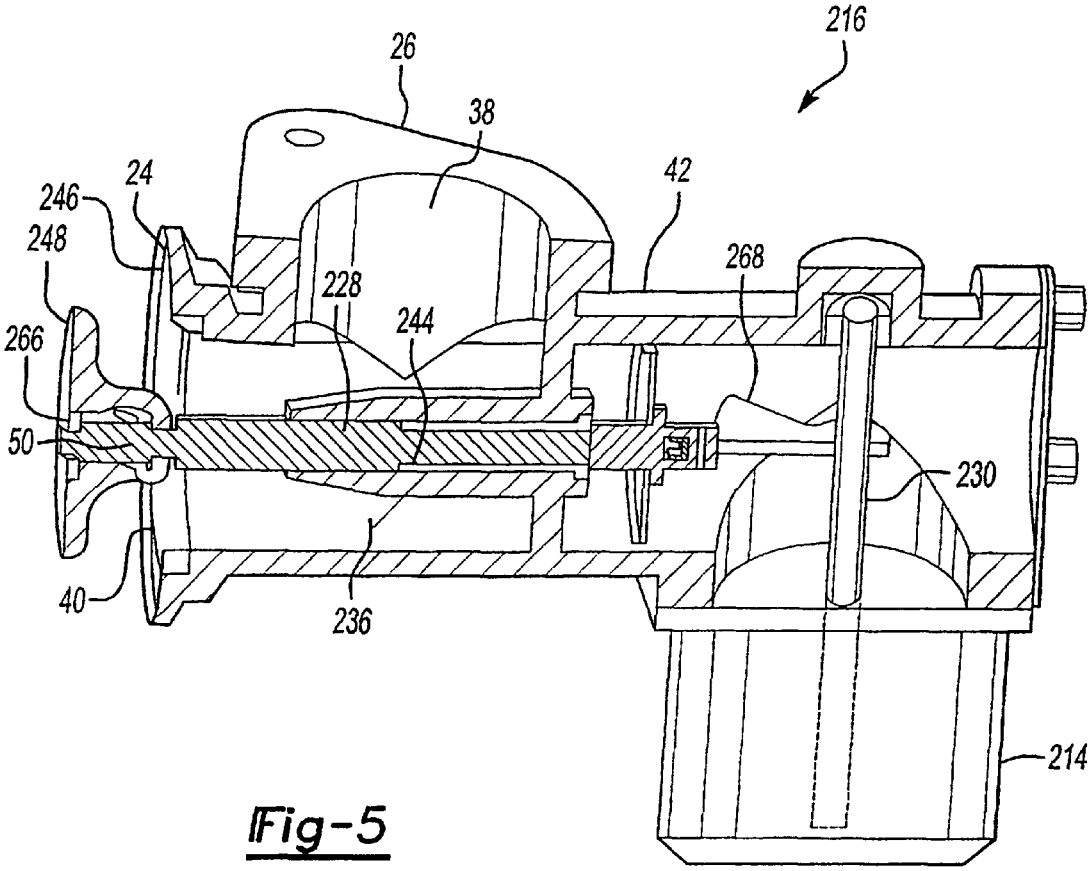
FIG. 5 illustrates an interior cross sectional view of a third embodiment of the valve apparatus with the force balanced rotary valves opened.

FIG. 5 illustrates a third embodiment of the EGR valve assembly 216 in an open position. An inline poppet 266 located on the pintle 248 opens to allow gas to enter the chamber 236 before the EGR valve 228 is opened. This overcomes the pressure in the system, reducing the force needed to open the EGR valve 228. The motor 214 rotates a shaft 230 which is connected to a cam 268, the cam 268 translating the rotary motion of the motor shaft 230 to the linear motion of the valve shaft 244 and opens the EGR valve 228. The degree of rotation of the motor shaft 230 determines the degree of the opening of the EGR valve 228. Rotation of the motor shaft 230 moves the pintle 248 towards or away from the orifice 246 to allow the desired amount of exhaust gas to enter the chamber 236.

Figure 6:
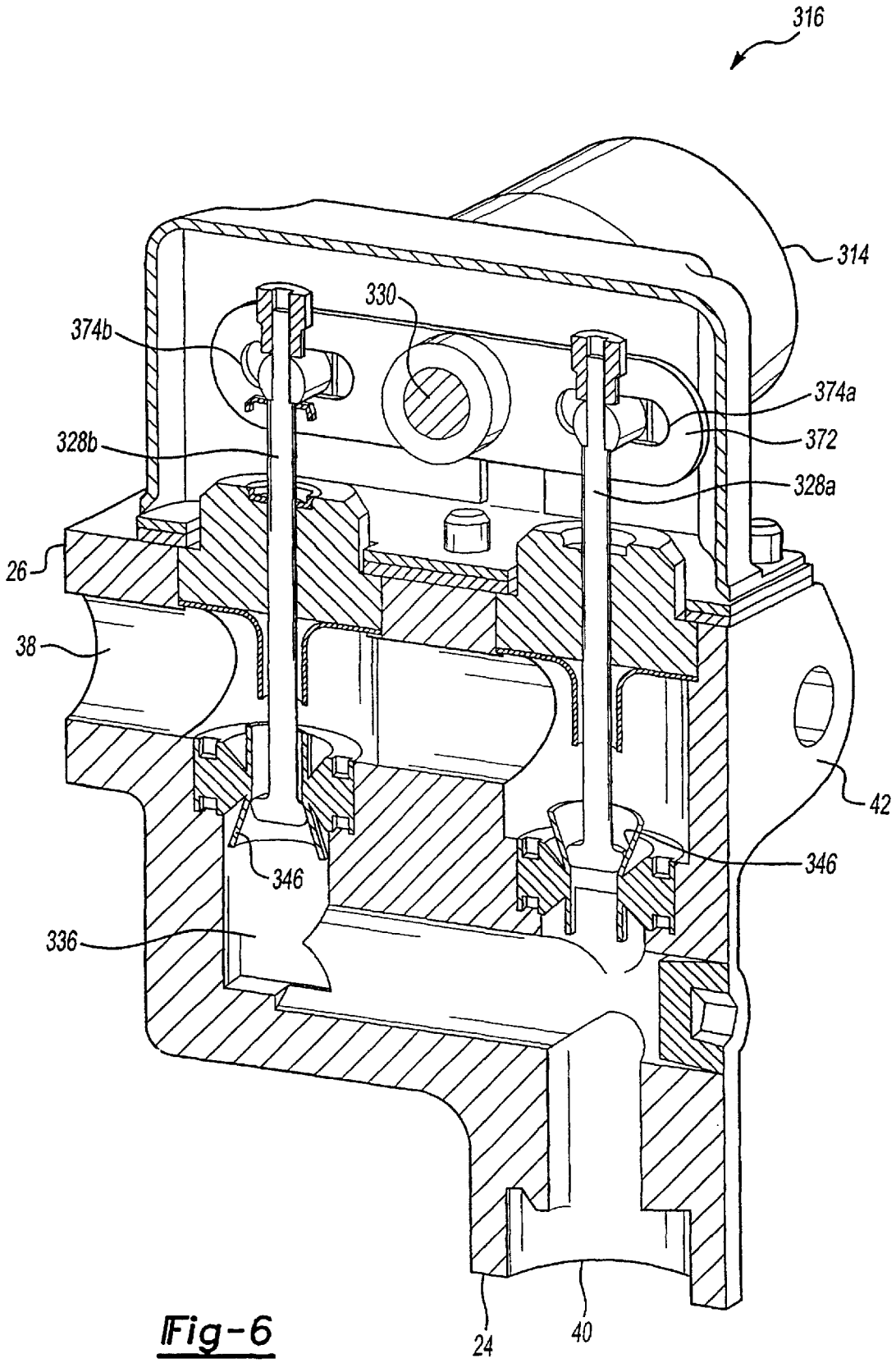
FIG. 6 illustrates an interior cross sectional view of a fourth embodiment of the valve apparatus.

FIG. 6 illustrates a fourth embodiment of valve assembly 316. The motor 314 rotates a motor shaft 330, pivoting a balance arm 372 so that a first end 374*b* of the arm 372 moves upwardly to raise the rotary EGR valve 328*b*, and the second end 374*a* of the arm 372 moves downwardly to lower the rotary EGR valve 328*a*. As the valves 328*a*, 328*b* move away from their respective orifices 346, more exhaust gas is allowed to enter the chamber 336. Reverse rotation of the shaft 330 reverses the movement of the valves 328*a*, 328*b*. The degree of the opening of the valves 328*a*, 328*b* is determined by the ECU 10.

FIG. 8 illustrates an alternate valve assembly 516 including a balance arm 572 moveable about a motor shaft 530. A first valve 528*b* is attached to a first end 574*b* of the balance arm 572, and a second valve 528*a* is attached to a second end 574*a* of the balance arm 572. The motor (not shown) rotates the motor shaft 530 to pivot the balance arm 572. Preferably, the valves 528*a* and 528*b* are covered by a plastic cover 566. In one example, the plastic cover 566 is made of zytel. Shaft bushings (not shown) are preferably positioned around the shaft 530 to assist in alignment of the valves 528*a* and 528*b*.

The first mounting face 524 of a housing 542 including a chamber 536 is fastened to an engine. When more exhaust gas is to enter the chamber 536, the shaft 530 is rotated to pivot the balance arm 572 to open the valve assembly 516 such that the first end 574*b* of the arm 572 moves upwardly to raise the first valve 528*b*, and the second end 574*a* of the arm 572 moves downwardly to lower the second valve 528*a*. After the valves 528*a* and 528*b* have been opened, exhaust gas flows from the engine into the chamber 536 through exhaust gas inlets 540*a* and 540*b* in a cooler. The exhaust gas exits the chamber 536 through an outlet 538 for cooling.

When less exhaust is to enter the chamber 536, the shaft 530 is rotated in the opposite direction to pivot the balance arm 72 to close the valve assembly 516 such that the first end 574*b* of the arm 572 moves downwardly to lower the first valve 528*b*, and the second end 574*a* of the arm 572 moves upwardly to raise the second valve 528*a*. The degree of rotation of the shaft 530 determines the amount the valves 528*a* and 528*b* are opened or closed.

Each valve 528*a* and 528*b* includes a pintle 548*a* and 548*b*, respectively, attached to a bottom portion 550 of a valve shaft 544. When no exhaust is to enter the housing 536, the pintles 548*a* and 548*b* of the valves 528*a* and 528*b* fit securely into an orifice 546*a* and 546*b*, respectively, in the first mounting face 524 of the housing 542, preventing exhaust from entering the housing 536 through the inlets 540*a* and 540*b* and from being recirculating into the system.

As the valves 528*a* and 528*b* are moved and fluid flows through the orifices 546*a* and 546*b* into the chamber 536, the valve 528*a* moves with the flow of the exhaust fluid and the valve 528*b* moves against the flow of exhaust fluid. As these forces are balanced, no additional forces are provided on the motor during movement of the valves 528*a* and 528*b*.

The outer edge of the pintle 548*b* includes is angled upwardly. When the valve 528*b* is closed, the outer edge of the pintle 548*b* contacts the orifice 546*b*, breaking off any soot from the exhaust that collects on the pintle 548*b*. The outer edge of the pintle 548*a* is angled downwardly. Any soot accumulating on the pintle 548*b* will drain off the pintle 548*b*. By eliminating the buildup of soot on the pintles 548*a* and 548*b*, the sticking of the pintles 548*a* and 548*b* in the orifices 546*a* and 546*b* is reduced, creating a better seal between the pintles 548*a* and 548*b* and the orifices 546*a* and 546*b*.

An arm 576 is received in a hole 578 in each end 574*a* and 574*b* of the balance arm 572. An upper portion 558 of each valve shaft 544 is secured to each arm 576. In one example, the upper portion 558 of each valve stem 544 is orbital riveted to the arm 576, reducing and eliminating vibrations. As the balance arm 572 moves about the shaft 530, the arms 576 pivot in the holes 578, translating the rotary motion of the shaft 530 into the linear motion of the valves 528*a* and 528*b*.

Each valve shaft 544 further includes a reduced diameter portion 554 received in a stem shield 556. Each stem shield 556 includes an aperture 557 sized to receive the reduced diameter portion 554. As the valves 528*a* and 528*b* are opened and closed, the interaction of the reduced diameter portion 554 and the stem shield 556 rubs off any soot and condensation, reducing any soot and condensation that forms at the interface 559.

A portion of the valve shafts 544 are positioned in a cooling chamber 552. The coolant enters a path 551 around the cooling chamber 552 through an inlet 550 and circulates around the valve shafts 544 to provide cooling. The coolant exits the cooling chamber 552 through an outlet (not shown) located next to the inlet 550. The cooling chamber 552 is secured to the housing 542 by attachment members 567 to eliminate any vibrations. Preferably, the attachment members 567 are bolts.

A bushing 560 positioned around the each of the valve shafts 554 is received in the coolant chamber 552. The bushing 560 is preferably made of sintered bronze or vespel to reduce friction between the bushing 560 and the valve shaft 544. The interaction of the bushing 560 and the valve shaft 544 also reduces and eliminates soot and condensation that build up on the valve stem 544 and bushing 560 interface. A lip seal 562 is fitted on the top of the bushing 560 and is retained by a seal retainer 564.

The valve apparatus 516 further includes a resilient member 568 positioned around the shaft 530. In one example, the resilient member 568 is a spring. The resilient member 568 biases the valves 528*a* and 528*b* to the closed position. In the event of a power loss, the resilient member 568 closes the valve assembly 516 and acts as a fail-safe mechanism.

Figure 7:
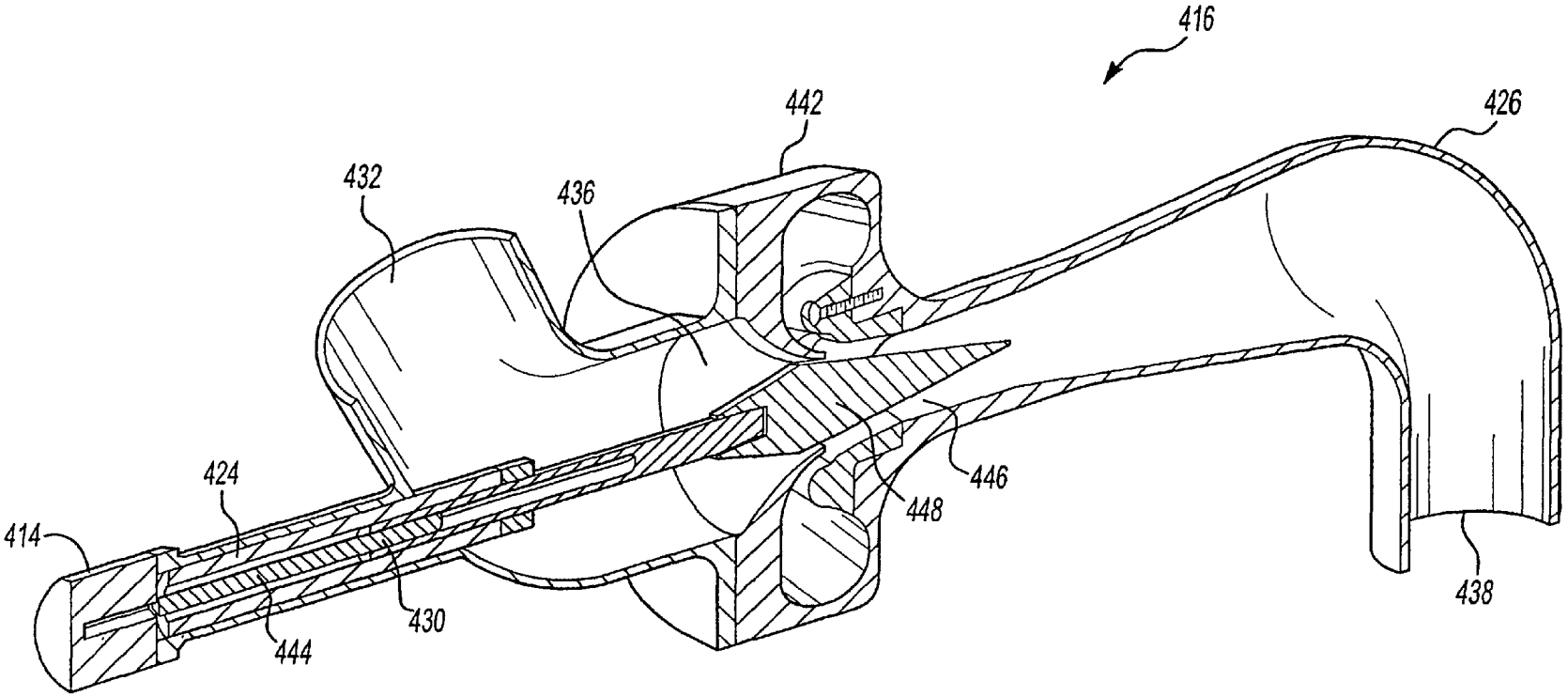
FIG. 7 illustrates a perspective internal view of an air venturi assembly of a fifth embodiment of the present invention.

FIG. 7 illustrates an air venturi valve apparatus 416. Fresh air enters from a fresh air inlet 432 in a first elongated tube 424 and exhaust gas enters from an exhaust gas inlet, mixing in a chamber 436 of a housing 442. The fresh air/exhaust gas mixture exits the housing 442 through a fresh air/exhaust gas mixture outlet 438 in a second elongated tube 426, leading back to the system.

When the fresh air/exhaust gas mixture is to be released back into the system, the motor 414 rotates a shaft 444 of a poppet 430 threaded in the first elongated tube 424, separating a pintle 448 from an orifice 446. As the pintle 448 moves away, the fresh air/exhaust gas mixture passes through the orifice 446 and into the system. The farther away the pintle 448 is positioned from the orifice 446, the more fresh air/exhaust gas mixture is allowed to pass through the orifice 446 and back into the system.

By rotating the threaded valve shaft 444, the pintle 448 of the poppet 430 can be repositioned depending on the system requirements. When no fresh air/exhaust gas mixture is to be allowed back into the system, the valve shaft 444 is rotated such that the pintle 448 is secured in the orifice 446, blocking the flow of fresh air/exhaust gas into the second elongated tube 426 and into the system.

There are many advantages to operating the EGR system with the electric D/C motor 14. First, the motor 14 can proportionally open the valves 28, allowing for various flow ranges. Secondly, the motor 14 achieves a faster response than the vacuum actuators of the prior art. Additionally, this EGR system reduces space requirements within the engine compartment due to the compact size of the motor 14.

The foregoing description is exemplary rather then defined by the limitations within. Many modifications and variations of the present invention are possible in light of the above teachings. The preferred embodiments of this invention have been disclosed, however, so that one of ordinary skill in the art would recognize that certain modifications would come within the scope of this invention.

What is claimed is:

1. A method for regulating a flow of an exhaust gas in an exhaust gas recirculation system comprising the steps of:

providing a housing defining at least one opening, at least one valve and an opposing valve coupled to a rotatable shaft and extending transverse to an axis of rotation of said shaft, said at least one valve and said opposing valve being on opposing sides of said rotatable shaft;

rotating said shaft; and moving said at least one valve and said opposing valve linearly between a first position closing said opening and a second position spaced from said opening.

2. A method for regulating a flow of an exhaust gas in an exhaust gas recirculation system comprising the steps of:

generating a signal having a first voltage;

modifying said signal to a modified signal having a second voltage greater than said first voltage;

receiving said modified signal; and actuating at least one valve and an opposing valve of a valve apparatus between a first position closing an opening and a second position spaced from said opening.

3. A valve apparatus for regulating a flow of an exhaust gas comprising:

a housing defining at least one opening;

a shaft rotatable about an axis; and at least one valve and an opposing valve attached to said rotatable shaft and extending transverse to said axis of rotation of said shaft, a force acting on said at least one valve during movement of said at least one valve is substantially equal and opposite to an opposing force acting on said opposing valve during movement of said opposing valve, said force and said opposing force balancing each other.

4. An exhaust gas recirculation system for regulating a flow of an exhaust gas comprising:

an engine control unit which generates a signal having a first voltage;

a pilot circuit electrically connected between said engine control unit and an actuator which receives said signal and modifies said signal to a modified signal having said second voltage greater than said first voltage;

said actuator electrically connected to said engine control unit for receiving said modified signal; and a valve apparatus including a housing defining at least one opening coupled to said actuator and including at least one valve and an opposing valve moveable between a first position closing each of said at least one opening and a second position spaced from each of said at least one opening.

5. The exhaust gas recirculation system as recited in claim 4 wherein there is one said at least one valve and one said opposing valve.

6. The exhaust gas recirculation system as recited in claim 4 wherein said exhaust gas enters said system from an engine and exits said system into a cooler.

7. The system as recited in claim 4 wherein each of said at least one valve and said opposing valve are coupled to a rotatable shaft and extend transverse to an axis of rotation of said shaft and are linearly moveable between said first position and said second position.

8. The system as recited in claim 7 wherein each of said at least valve and said opposing valve are positioned on opposing sides of said rotatable shaft, rotation of said rotatable shaft moving each of said at least one valve in a first direction and moving said opposing valve in an opposing second direction.

9. The system as recited in claim 7 wherein rotation of said rotatable shaft in a first direction moves said at least one valve and said opposing valve linearly to said first position and rotation of said rotatable shaft in an opposing second direction moves said at least one valve and said opposing valve linearly to said second position.

10. The system as recited in claim 7 wherein each of said at least one valve and said opposing valve are each connected to a pivotable arm positioned on said shaft, said arms transferring rotational movement of said rotatable shaft to linear movement of each of said at least one valve and said opposing valve.

11. The system as recited in claim 4 wherein a balance arm is attached to said shaft and said at least one valve is positioned on a first end of said balance arm and said opposing valve is positioned on an opposing second end of said balance arm, rotation of said shaft moving said first end and said second end of said balance arm in opposing directions.

12. The system as recited in claim 11 wherein rotation of said rotatable shaft moves each said first end and said at least one valve in a first direction and moves said second end and said opposing valve in an opposing second direction.

13. The apparatus as recited in claim 11 wherein rotation of said rotatable shaft in a first rotatable direction moves said at least one valve and said opposing valve linearly to said first position and rotation of said shaft in an opposing second rotatable direction moves said at least one valve and said opposing valve linearly to said second position.

14. A valve apparatus for regulating a flow of an exhaust gas comprising:

a housing defining at least one opening;

a shaft rotatable about an axis; and at least one valve and an opposing valve attached to said rotatable shaft and extending transverse to said axis of rotation of said shaft and linearly moveable between a first position closing each of said at least one opening and a second position spaced from each of said at least one opening.

15. The apparatus as recited in claim 14 wherein there is one said at least one valve and one said opposing valve.

16. The apparatus as recited in claim 14 wherein each of said at least valve and said opposing valve are positioned on opposing sides of said shaft, rotation of said shaft moving each of said at least one valve in a first direction and moving said opposing valve in an opposing second direction.

17. The apparatus as recited in claim 16 wherein rotation of said rotatable shaft in a first rotatable direction moves said at least one valve and said opposing valve linearly to said first position and rotation of said shaft in an opposing second rotatable direction moves said at least one valve and said opposing valve linearly to said second position.

18. The apparatus as recited in claim 16 wherein each of said at least one valve and said opposing valve are each connected to a pivotable arm positioned on said rotatable shaft, said arms transferring rotational movement of said rotatable shaft to linear movement of each of said at least one valve and said opposing valve.

19. The apparatus as recited in claim 16 wherein said shaft is rotatable 20° to move said at least one valve and said opposing valve between said first position and said second position.

20. The apparatus as recited in claim 14 wherein a balance arm is attached to said rotatable shaft and said at least one valve is positioned on a first end of said balance arm and said opposing valve is positioned on an opposing second end of said balance arm, rotation of said rotatable shaft moving said first end and said second end of said balance arm in opposing directions.

21. The apparatus as recited in claim 20 wherein rotation of said rotatable shaft moves said first end and said at least one valve in a first direction and moves said second end and said opposing valve in an opposing second direction.

22. The apparatus as recited in claim 20 wherein rotation of said rotatable shaft in a first rotatable direction moves said at least one valve and said opposing valve linearly to said first position and rotation of said shaft in an opposing second rotatable direction moves said at least one valve and said opposing valve linearly to said second position.

23. The apparatus as recited in claim 20 wherein a center of said balance arm is attached to said shaft.

24. The apparatus as recited in claim 20 wherein said at least one valve includes a first pintle having an outer edge angled substantially upwardly and said opposing valve includes a second pintle having an outer edge angled substantially downwardly, said first pintle engaging a first orifice shaped to receive said first pintle and a second pintle engaging a second orifice shaped to received said second pintle when said at least one valve and said opposing valve are in said first position.

25. The apparatus as recited in claim 20 further including a resilient member positioned around said rotatable shaft to bias said at least one valve and said opposing valve to said first position.

26. The apparatus as recited in claim 25 wherein said resilient member is a spring.

27. The apparatus as recited in claim 20 wherein said at least one valve and said opposing valve each include a valve shaft, and an upper portion of each of said valve shafts are orbitally riveted to each of said balance arm.

28. The apparatus as recited in claim 27 wherein each of said valve shafts include a reduced diameter portion that is received in a shield, and interaction of said reduced diameter portion with said shield eliminates collection of material at an interface between said reduced diameter portion and said opening.

29. The apparatus as recited in claim 27 wherein a portion of each of said valve shafts is positioned in a cooling chamber, said cooling chamber is secured to said housing by an attachment member, and a coolant flows in said cooling chamber to cool said portion of said valve shaft.

30. The apparatus as recited in claim 29 wherein said portion of said valve shaft is received in a bushing in said cooling chamber, interaction of said valve shaft and said bushing eliminates collection of material at an interface between said bushing and said valve shaft.

31. The apparatus as recited in claim 30 further including a lip seal fitted on a top of said bushing to create a seal.

* * * * *